US009679736B2

(12) United States Patent
Lan et al.

(10) Patent No.: US 9,679,736 B2
(45) Date of Patent: Jun. 13, 2017

(54) ENCAPSULATED STRUCTURE FOR X-RAY GENERATOR WITH COLD CATHODE AND METHOD OF VACUUMING THE SAME

(71) Applicant: Energy Resources International Co., Ltd., New Taipei (TW)

(72) Inventors: Wen-How Lan, New Taipei (TW); Yi-Teng Shiu, New Taipei (TW); Hung-Chiang Huang, New Taiepi (TW)

(73) Assignee: Energy Resources International Co., Ltd., New Taipei (TW)

( * ) Notice: Subject to any disclaimer, the term of this patent is extended or adjusted under 35 U.S.C. 154(b) by 41 days.

(21) Appl. No.: 14/948,015

(22) Filed: Nov. 20, 2015

(65) Prior Publication Data

US 2016/0148777 A1 May 26, 2016

(30) Foreign Application Priority Data

Nov. 20, 2014 (TW) ..... 103140325 A

(51) Int. Cl.
*H01J 35/06* (2006.01)
*H01J 9/39* (2006.01)

(52) U.S. Cl.
CPC ..... *H01J 35/065* (2013.01); *H01J 9/39* (2013.01)

(58) Field of Classification Search
CPC ..... H01J 35/065; H01J 2235/068; H01J 2235/062; H01J 35/06; H01J 35/08; H01J 35/16; H01J 2201/30469; H01J 1/304
See application file for complete search history.

(56) References Cited

U.S. PATENT DOCUMENTS

| | | | | |
|---|---|---|---|---|
| 6,353,658 | B1 * | 3/2002 | Trebes | A61N 5/1001 378/119 |
| 6,553,096 | B1 | 4/2003 | Zhou et al. | |
| 8,559,599 | B2 | 10/2013 | Lee et al. | |
| 2005/0031083 | A1 * | 2/2005 | Kindlein | A61N 5/1001 378/136 |
| 2011/0255664 | A1 * | 10/2011 | Ueda | H01J 35/065 378/62 |
| 2013/0028386 | A1 * | 1/2013 | Jeong | H01J 35/20 378/122 |

* cited by examiner

*Primary Examiner* — Hoon Song
(74) *Attorney, Agent, or Firm* — Muncy, Geissler, Olds & Lowe, P.C.

(57) ABSTRACT

An encapsulated structure of an X ray generator with a cold cathode and method of vacuuming the same are disclosed. The X ray generator has a glass ball-tube having a base, a tungsten filament, a cold cathode, a focus cap, and an anode target inside, associated with a first electrode pin, a second electrode pin, a single-used pin, and anode pin extended out. The tungsten filament located at the periphery of the base has a first wire end connected with the second electrode pin and a second wire end connected with the single-used pin. While vacuuming the glass ball-tube before melting an end to seal, a voltage is exerting on the single use pin to heat the tungsten, and a high voltage is exerting on the anode target to accelerate the hot electrons emitting from the filament to bombard the inside wall of the glass ball-tube and the anode target so as to shorten the vacuuming time and increase the vacuum level.

10 Claims, 6 Drawing Sheets

ENCAPSULATED STRUCTURE FOR X-RAY GENERATOR WITH COLD CATHODE AND METHOD OF VACUUMING THE SAME

FIELD OF THE INVENTION

The present invention pertains to an X-Ray generator with a cold cathode, in particularly, to a process of heating a tungsten filament and vacuuming a glass ball-tube container simultaneously in an X-Ray generator encapsulated process.

DESCRIPTION OF THE PRIOR ART

An x-ray generation device with a cold cathode generating field emission electrons is known according to a quantum theory of field electron emission. The basic principle of the field emission electrons is that the electrons of a conductor must have sufficient energy to get a chance to cross the potential energy barrier to the vacuum side when no electric field is applied. When an electric field is applied the energy band is bent, as a result, electrons cross the potential energy barrier to the vacuum side without huge amount of energy. When the applied electric field is increasing, the potential energy barrier by electrons is decreasing and the strength of the derived current is increasing. According to electromagnetic theory, if a charged object has a sharp point, the electric field strength around that point will be much higher than elsewhere. Air near the electrode can become ionized (partially conductive), while regions more distant do not. Therefore, for a field emission cathode, more upperward carbon fibers are desired so that the electric field will be generated even the applied voltage on the cathode is low.

At present time, an x-ray generation device usually serves as an electron source within a microwave element, sensor, panel display, or the like. The efficiency of electron emission mostly depends on the element structure, material, and shape of a field emission cathode (i.e. an x-ray generation device). A field emission cathode is made of metal, such as silicon, diamond, and carbon nano-tube. Among these materials, carbon nano-tube is particularly important because its openings are extremely thin and stable, it has low conducted field and high emitting current density, and it is highly stable. With these characteristics, carbon nano-tube is extremely suitable for a field emission cathode. Therefore, it is highly possible that carbon nano-tube will replace other materials and becomes the material of field emission in the next generation.

Field emission cathode can serve as a cathode of an x-ray generation device, such as an x-ray tube. An x-ray generation device encapsulates a cathode, electromagnetic-lens aperture, and an anode target within a glass container. The conventional thermionic cathode neon tube can be replaced by the carbon nano-tube. When using a thermionic cathode neon tube in an x-ray generation device, around 99% of electricity is transformed to heat. Thus, the thermionic cathode neon tube must be cool down by cooling water. On the contrary, carbon nano-tube can emit electron beams under smaller electric field intensity, so the efficiency of transferring electricity to electronic beams is higher than that of thermionic cathode nano-tube. In addition, cooling process is not required when using carbon nano-tube in an x-ray generation device.

The U.S. Pat. No. 6,553,096 presented by Zhou et al. discloses an x-ray generation device adopting carbon nanotubes. Zhou et al. use materials with nanometer structures as an emitting source of a cathode field emission. Furthermore, Zhou et al. claimed that generating a current density of about 30 mA/cm$^2$ can be achieved by an x-ray generator using carbon nano-tubes. The x-ray generator has a threshold electric field of about 3.5 V/μm.

Since the threshold is still too high to use for a hand-held x-ray device, the inventors of the present invention discloses a novel x-ray generator having a threshold electric field as low as 0.3 V/μm. Please refer to U.S. Pat. No. 8,559,599. Referring to FIG. 1, it shows a schematic diagram of the cold cathode 111, which includes a plurality of metal rods having a carbon film 110*c* form on their surfaces thereof supported by a base 110 with sidewalls 110W. While an encapsulating process the X ray generator into a glass ball-tube is carried out, the vacuumed process spend about 3 hours to reach the 1.0 E-8 to 1.0 E-9 torr vacuum level. Besides, the X ray generator device can be used only for a very short time, e.g., 100 snap-shots. After that, the X-ray photo-quality becomes worse. The inventors found the reasons of bad photo-quality is possibly due to the vacuum level in the glass ball-tube is deteriorated after a short period of time. Therefore an object of the present invention is to overcome this problem. Another object of the present invention is to solve the problem of corona discharge found at electrode pin of the X ray generator.

SUMMARY OF THE INVENTION

An object of the present invention is to provide an encapsulated structure of the X-ray generator with a cold cathode having a vacuum level keeping as the initial even after the X-ray generator used for a long time so as to keep the X-ray photo quality well.

The other object of the present invention is to provide a method to reduce vacuuming time cost before an opening of the X-ray glass ball-tube is melting to seal, during an encapsulating process.

Another object of the present invention is to provide an X-ray glass ball-tube structure includes an insulating gel having extremely high breakdown voltage resist avoiding corona discharge at the electrode pins.

The present invention discloses an encapsulated structure of an X ray generator with a cold cathode and method of vacuuming the same. The X ray generator has a glass ball-tube having a base, a tungsten filament, a cold cathode, a focus cap, and an anode target inside, associated with a first electrode pin, a second electrode pin, a single-used pin, and anode pin extended out. The tungsten filament located at the periphery of the base has a first wire end connected with the second electrode pin and a second wire end connected with the single-used pin. While vacuuming the glass ball-tube before melting an end to seal, a voltage is exerting on the single use pin to heat the tungsten, and a high voltage is exerting on the anode target to accelerate the hot electrons emitting from the filament to bombard the inside wall of the glass ball-tube and the anode target so as to shorten the vacuuming time and increase the vacuum level.

DESCRIPTION OF THE PREFERRED EMBODIMENT

Figure 1:
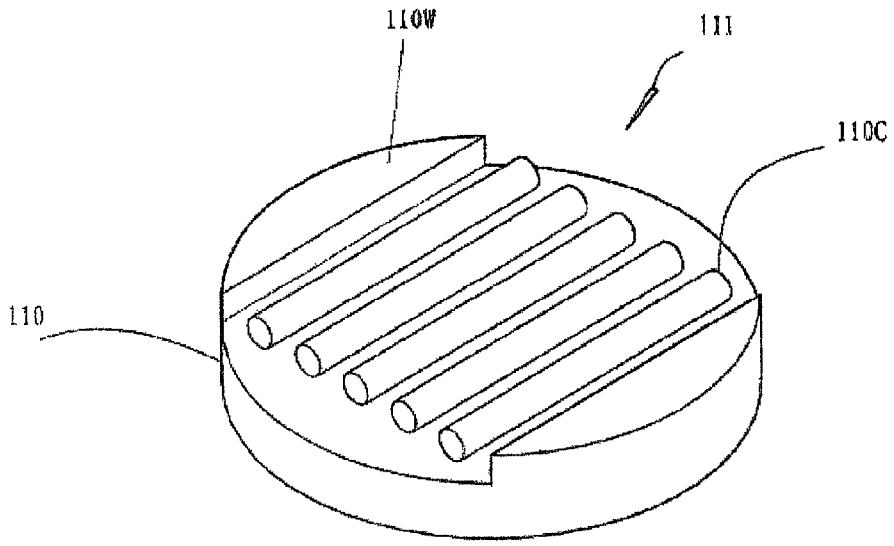
FIG. 1 is a schematic diagram of a cold cathode of an X ray generator in accordance with a prior art.
Figure 2A:
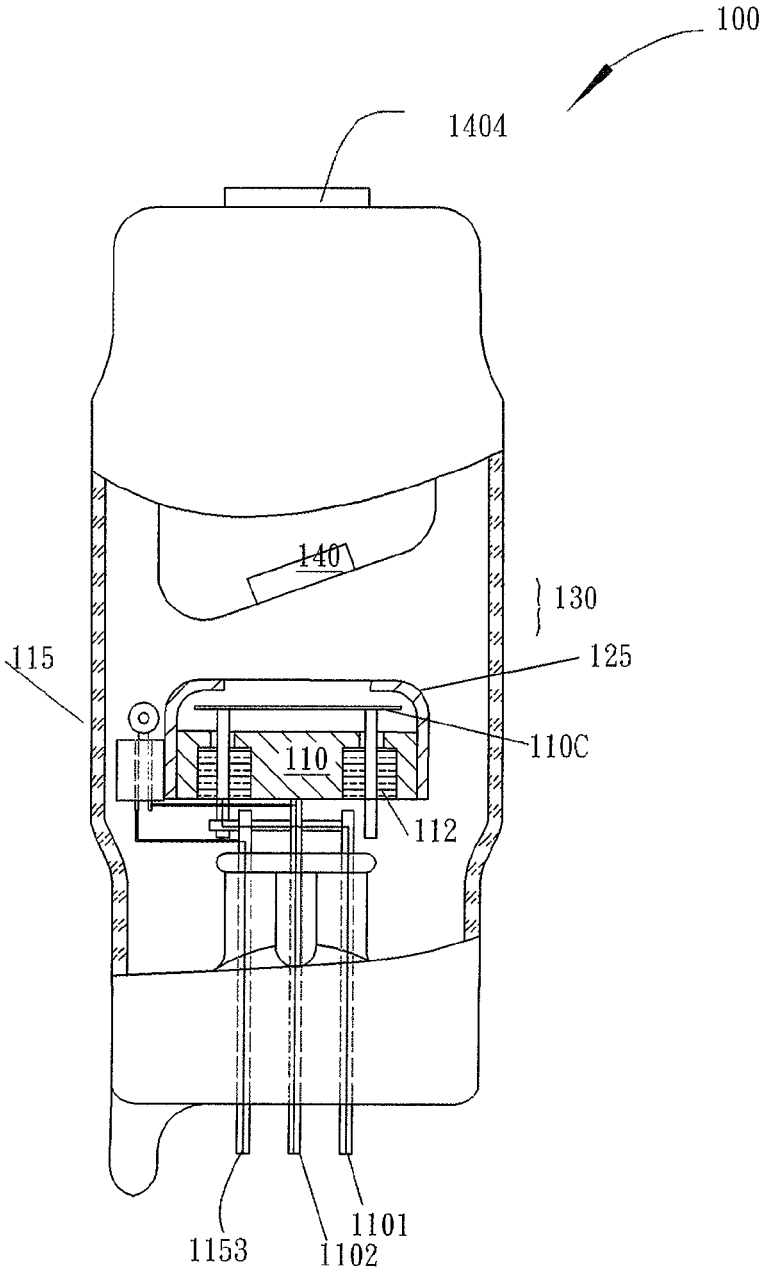
FIG. 2A illustrates a sectional view of an X ray generator with three electrode pins and an anode pin extended out the glass ball-tube and a tungsten filament at periphery of the base in accordance with the present invention.
Figure 2B:
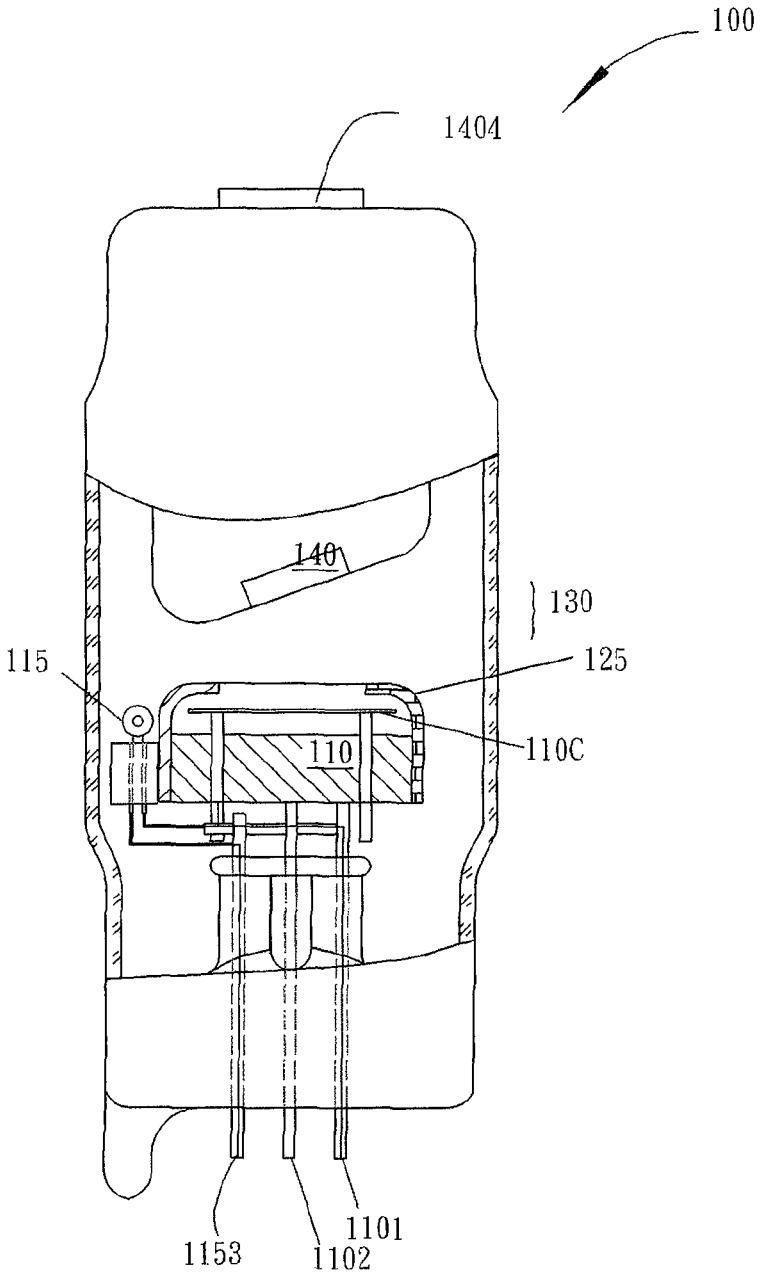
FIG. 2B illustrates a sectional view of an X ray generator with two electrode pins, and an anode pin extended out of the glass ball-tube and a tungsten filament at periphery of the base in accordance with the present invention.
Figure 2C:
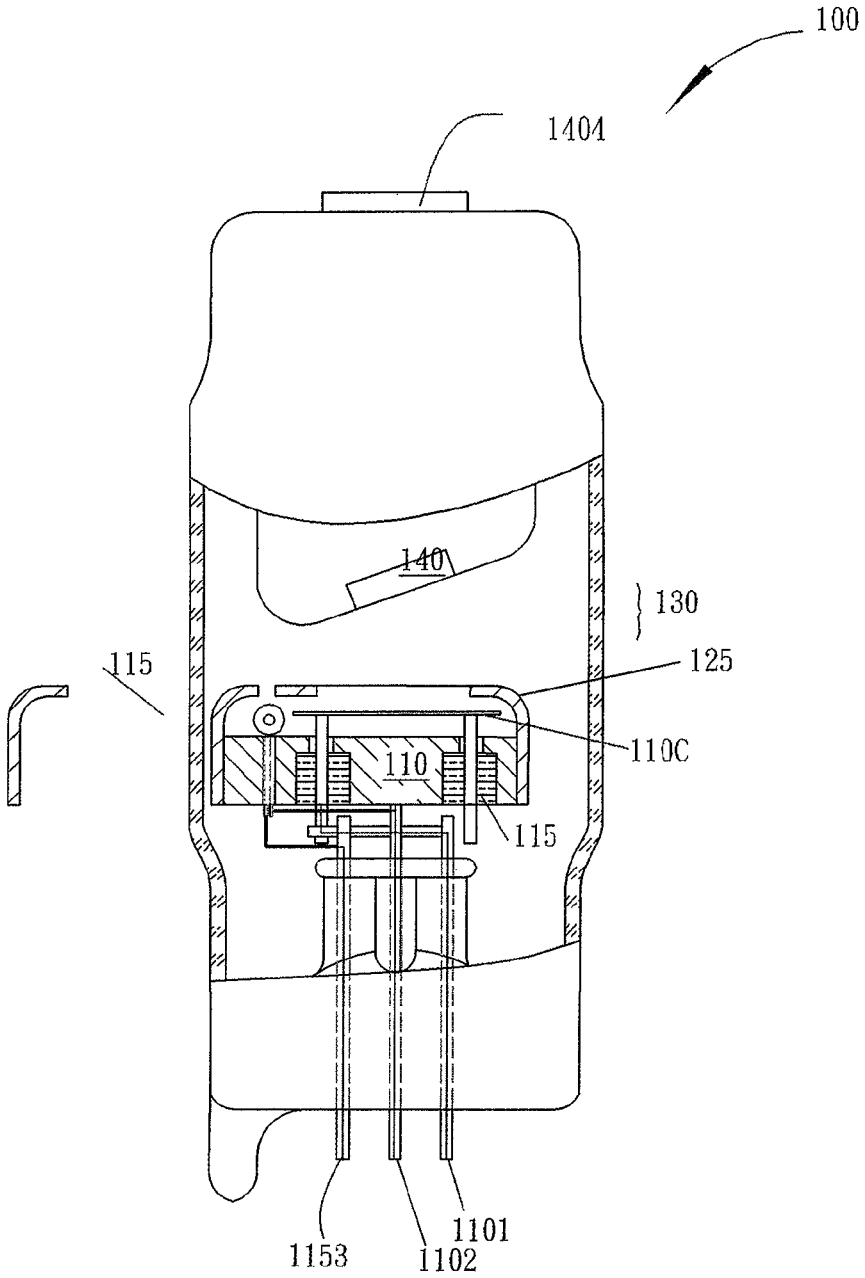
FIG. 2C illustrates a sectional view of an X ray generator having three electrode pins and an anode pin extended out of the glass ball-tube and a tungsten filament at periphery of the base and inside the focus cap in accordance with the present invention.

The present invention discloses an X ray generator has a glass ball-tube100 having a base 100, a cold cathode 110C, a focus cap 125, a tungsten filament 115, and an anode target 140 having a incline plane facing to the cold cathode 110C in a way that the generated X-rays due to the cold electrons hitting the incline plane 140 are capable of through an X ray window 130 out. The X ray generator may have three electrode pins 1101, 1102, 1153, and an anode pin 1404 extended out of the glass ball-tube, as shown in FIG. 2A and 2C or two electrode pins 1101, 1153, as shown in FIG. 2B. In case of two electrode pins of glass ball-tube100, one of the two electrode pins1101, 1102 is a dummy pin since the electrode pin 1101, 1102 has the same potential. Dummy pin, 1101, or 1102 is used to support the X ray generator stand upright. The anode target 140 is connected with an anode pin 1404.

The distinct point between the FIG. 2A and FIG. 2C is the position of the tungsten filament 115, outside the focus cap 125, as shown in FIG. 2A, or, inside it, as shown in FIG. 2C. In the three electrode pins of X ray generator, the second electrode pin 1102 is electrically connected with the focus cap 125, the base 110 and a first wire end of the tungsten filament 115. The first electrode 1101 is electrically connected with the cold cathode 110. The base 110 is electrically isolated from the cold cathode 110C by an insulator 112 such as a ceramic. The third electrode pin 1153 is a single use pin connected with a second wire end of the tungsten filament 115. Herein "single use pin" means it is used only in a vacuuming the glass ball-tube process. The third electrode pin 1153 is nothing to do with the operation of the X-ray generator.

Referring to FIG. 2B, it illustrates two electrode pins of an X ray generator. A tungsten filament 115 is at the periphery of the base and outside the focus cap 125. It is just an exemplary not intend to limit. The same as above, the tungsten filament 115 may be disposed inside the focus cap 125. In the two electrode pins of the X ray generator, the second electrode pin 1102 is electrically connected with the first electrode pin 1101, the focus cap 125, the base 110, the cold cathode 110C and a first wire end of the tungsten filament 115. The third electrode pin 1153 is a single use pin connected with a second wire end of the tungsten filament 115. The third electrode pin 1153 is nothing to do with the operation of the X-ray generator.

The function of the tungsten filament 115 is used in the vacuuming process to the glass ball-tube only, and nothing with the operation of the X-ray generator. Thus the position of the tungsten filament 115 is located at the periphery of the base, so that it will not hinder the cold electrons emitted from the cold cathode. Before the glass ball-tube is sealed, the glass ball-tube 100 is vacuuming, a voltage of about 2V~10V is exerted on the third electrode pins 1153 and the second electrode pin is grounded to generate a current of about 1~5 A to heat the tungsten filament 115 so as to generate hot electrons. And a high voltage as high as several thousand volts to several tens of thousands e.g. 70 kV is preferred to further applied on the anode pin 1404 so as to accelerate the hot electrons bombard any organic material, moisture, contamination out of the inner glass ball-tube 100, and the anode target 140. The hot electrons have very lightly mass so that the accelerated hot electrons can bombard the contamination out without cause the glass ball-tube damage. The dissociate contaminations are then vacuuming out.

During the vacuuming process, heating turn on and heating off process to the tungsten filament 115, are preferred to be alternative in turn to prevent glass ball-tube from overheating. The rest time i.e., heating off may be 1-5 minutes. After several ON and OFF alternative processes, any contaminations attached on the inner wall of the glass ball-tube 100 and anode target 140 will be throughout removed and cleaned. For a glass ball-tube 100 with a diameter of about 30-45 mm in section, or 40-60 $mm^3$ in volume, the vacuuming time cost including any heating turn off time is of about 1 hour. Thereafter, the end opening of the glass ball-tube is sealed by melting out.

It is found that a glass ball-tube with a tungsten filament 115 to assist the vacuuming process not only shorten the vacuuming time cost but also prompt the X-ray photo quality while comparing with the glass ball-tube without a tungsten filament.

An X-ray generator with a single use tungsten filament 115 can keep the X-ray photo quality as the initial even after 10,000 shot. By contrast, the X-ray photo quality is found to be deteriorated for an X-ray generator without a single use tungsten filament 115 due to deteriorated vacuum level in the glass ball-tube.

After sealing the end opening by melting, the glass ball-tube 100 has four electrode pins 1101, 1102, 1153, 1404 extended out of the glass ball-tube.

In an X-ray generator with two electrode pins, the cold cathode 110C is constituted by a plurality of metal rods 110C1 formed each with a carbon layer 110C2 thereon, which are fixed on a base 100 with a planar surface by a silver gel or solder. The metal rods 110C1 may be formed of nickel or platinum.

In an X-ray generator with three electrode pins, the foresaid metal rods 110C1 are fixed by insulating material such as ceramic. The metal bars 110C1 are connected with the first electrode pin 1101.

Figure 2E:
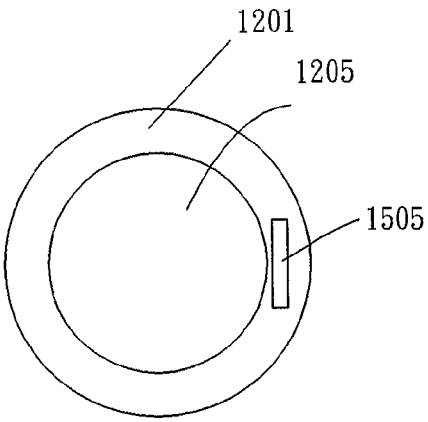
FIG. 2E is a schematic side-view of a base having a carbon film formed on a convex surface served as the cold cathode and the tungsten filament at the periphery of the base in accordance with the present invention.
Figure 2D:
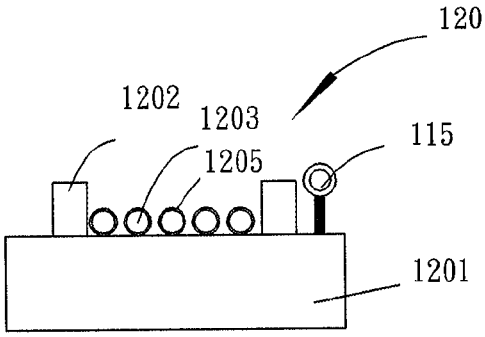
FIG. 2D is a schematic side-view of the cold cathode on the base and the tungsten filament at the periphery of the base in accordance with the present invention.
Figure 2F:
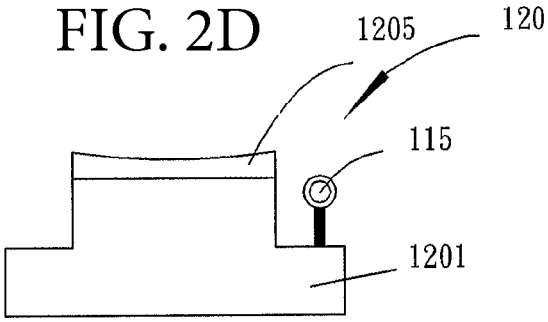
FIG. 2F is a schematic side-view of a base having a carbon film formed on a concave surface served as the cold cathode and the tungsten filament at the periphery of the base in accordance with the present invention.

In another preferred embodiment, the cold cathode 110C is a carbon film formed on a curve surface such as a convex surface, as shown in FIG. 2E or on a concave surface as shown in FIG. 2F.

To take X-ray photo of the human body, the voltage drop between the anode pin 1404 and the first electrode pin 111 is demanded to be as high as 50 kV-75 kV. Such a high voltage easily cause air breakdown in the vicinity of the anode pin 1404 and the first electrode pin 1101 to produce spark.

Figure 2G:
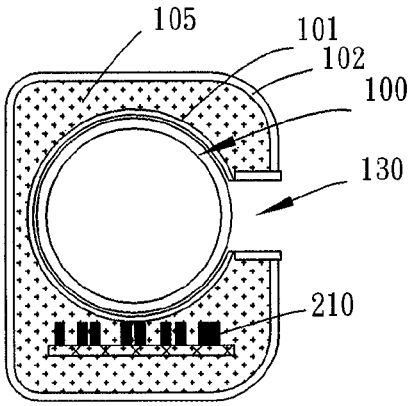
FIG. 2G is a schematic cross-sectional view cut along X-ray window of the X ray generator in accordance with the present invention.

Referring to FIG. 2G, a cross-sectional view cut along the X-ray window 130 is shown. It shows a lead foil 101 optionally coated on the glass ball-tube 100 except the X-ray window 130. The lead foil is of about 1 mm in thickness. The anode pin 1401 and the first electrode pin 1101 of X-ray generator are then connected with output terminals of the voltage booting module 210. The voltage booting module 210 are then packaged with the glass ball-tube by an insulating gel 105, which has a property of high voltage breakdown resist. Finally, the package then is coated by a second lead foil 102. In the above packaged process, the X-ray window 130 is always kept open.

The packaged structure with two thin foils, a first lead foils 101 inside and a second foil 102 outside thereof, is found better than just with singe but one thicker lead foil 102 outside. It can make the hand-held X-ray device by 10% weight reduce.

Figure 3:
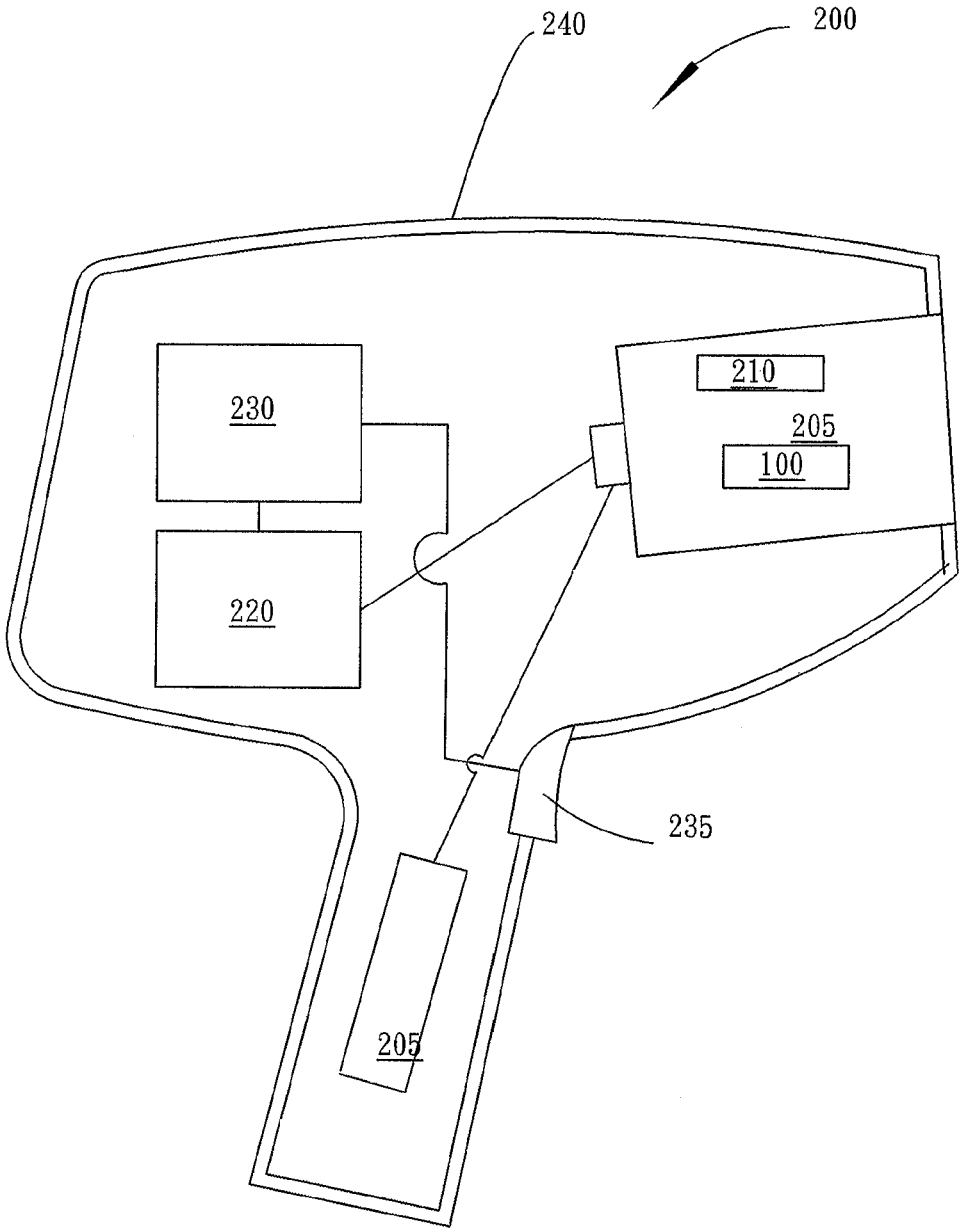
FIG. 3 illustrates a schematic diagram of a hand held X-ray device shown function modules in accordance with the present invention.

A preferred hand-held X ray device 200 may have a structure like a pistol, as shown in FIG. 3. The structure includes a glass ball-tube 100, voltage boosting module 210, a controlled module 230, a high-frequency oscillator module 220, a battery 205, and a shell 240. The controlled module 230 is controlled by a trigger 235. The battery 205 provides electrical power for the voltage boosting module 210, the controlled module 230, and the high-frequency oscillator module 220 to boot the low voltage to 50-70 keV, which is demanded to generate X-ray for human taken X-ray photo use.

According to the present invention, the X-ray generator in use provide a current as low as 100 μA-200 μA, which is just one tenth of that of a current used in a well-known X-ray hand-held device, Normad pro 2, made by ARIBEX company. The Normad pro 2 is a conventional X-ray device used a tungsten filament as a cathode to generate hot electrons. The current for this type X-ray generator is at least of about 1 mA and is demanded to be rest by at least 1 minute for 1 second shot so as to cool the X-ray generator.

The benefits of the present invention are:

(1). the hand-held X-ray generator can be shot continuously and with very good penetration under a voltage of about 65 kV. In comparison with the conventional hand-held X-ray device, the latter needs at least 1 minute rest for each shot by one second.

(2) The vacuum level in the glass ball-tube can be kept well so that the X-ray photo quality is the same as the initial even after several thousand shots. The X-ray photo quality is found becomes worse after 100 shots if the hand-held X-ray generator without a tungsten filament inside to assist vacuuming the glass ball-tube.

(3) The dosage of the X-ray is very low comparing with the Normad pro 2. Although the current is low, the X-ray photo quality is still very good. The X-ray generator used for human chest, dental care, and skeletal gives least damage and is thus better than the conventional, which has high dosage.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. An encapsulated structure of an X ray generator by a cold cathode, having a glass ball-tube in an order having a base, a cold cathode, a focus cap, and an anode target inside said glass ball-tube, associated with a first electrode pin, a second electrode pin, a single-used pin, and anode pin extended out, said anode target having an incline plane facing to said cold cathode in a way that the X-ray generated due to the cold electrons hitting said incline plane is capable of through an X ray window out, said first electrode pin connected with said cold cathode and said anode pin connected with said target anode, said encapsulated structure of an X ray generator characterized in that:

a tungsten filament at periphery of said base; and said second electrode pin connected with said base and a first wire end of said tungsten filament, said single-used pin connected with a second wire end of said tungsten filament so as to emit hot electrons by exerting a voltage thereon while vacuuming said glass ball-tube before an opening of said glass ball-tube is sealed.

2. The encapsulated structure of an X ray generator by a cold cathode according to claim 1 further comprises a voltage boosting module, a frequency oscillation circuit and a battery, said voltage boosting module having two electrical output terminals, respectively, connected with said first electrode pin and the anode pin, furthermore, said voltage boosting module and said glass ball-tube are packaged with an insulating gel except said X-ray window, said battery being worked with said voltage boosting module and said frequency oscillation circuit to provide 40 kV-70 kV high voltage for generating X rays.

3. The encapsulated structure of an X ray generator by a cold cathode according to claim 2 further comprises a first lead foil coated said glass ball-tube except said X-ray window.

4. The encapsulated structure of an X ray generator by a cold cathode according to claim 1 wherein said cold cathode has a plurality of metal rods supported by a base and each metal rod has a carbon film formed thereon to emit electrons.

5. The encapsulated structure of an X ray generator by a cold cathode according to claim 1 wherein said cold cathode is a carbon film formed on a convex surface of said base.

6. The encapsulated structure of an X ray generator by a cold cathode according to claim 1, wherein said first electrode pin and said second pin are electrically connected.

7. An encapsulated structure of an X ray generator by a cold cathode, comprises:

a voltage boosting module, a frequency oscillation circuit;

a battery, a glass ball-tube inside having a base, a tungsten filament seated at periphery of said base, a cold cathode, a focus cap, and an anode target, associated with first electrode pin, second electrode pin, a single-used pin, and anode pin extended out, said anode target having an incline plane facing to said cold cathode in a way that the X-ray generated due to the cold electrons hitting said incline plane is capable of through an X ray window out, said battery, said frequency oscillation circuit, and said voltage boosting module, operating to output a predetermined high voltage to said glass ball-tube, said voltage boosting module and said glass ball-tube being package by an insulating gel which is high-voltage breakdown resist.

said single-used pin connected with a second electrode pin of said tungsten filament so as to emit hot electrons by exerting a voltage thereon while vacuuming said glass ball-tube before an opening of said glass ball-tube is sealed;

a lead foil coated on said voltage boosting module and said glass ball-tube to prevent X-ray from leakage except an x-ray window.

8. The encapsulated structure of an X ray generator by a cold cathode according to claim 7, further comprises a first lead foil coated said glass ball-tube except said X-ray window.

9. A method of vacuuming a glass ball-tube of an X-ray generator, comprising steps of:

providing a glass ball-tube of an X-ray generator to be vacuumed, having a base, a tungsten filament, a cold cathode, a focus cap, and an anode target inside thereof, and an anode pin, a single use pin extended out, said tungsten filament located at periphery of said base, wherein, a first wire end and a second wire end of the tungsten filament, are connected, respectively to ground, and said single used pin;

exerting a voltage of about 2~10V, a current of about 1~5 A on said single used pin and exerting a voltage of about 1 kV~70 kV to said anode pin so as to accelerate hot electrons emitting from said tungsten filament meanwhile vacuuming said glass ball-tube; and sealing an opening of said glass ball-tube if a vacuum level of said glass ball-tube reaching a predetermined criteria.

10. The method of vacuuming a glass ball-tube of an X-ray generator according to claim 9, further comprising heating off time to prevent said glass ball-tube from over-heating while exerting said voltage on said single use pin to heat said tungsten filament.

* * * * *